United States Patent [19]

Gregor et al.

[11] 4,153,515

[45] May 8, 1979

[54] DISCHARGE APPARATUS FOR COKE-OVEN BATTERY

[75] Inventors: Karl Gregor, Bochum; Kurt Asmus, Erftstadt, both of Fed. Rep. of Germany

[73] Assignee: Gewerkschaft Schalker Eisenhütte, Gelsenkirchen, Fed. Rep. of Germany

[21] Appl. No.: 651,777

[22] Filed: Jan. 23, 1976

[30] Foreign Application Priority Data

Jul. 4, 1975 [DE] Fed. Rep. of Germany ..... 2529805

[51] Int. Cl.[2] ..... C01B 33/04; C10B 33/10; C10B 43/00

[52] U.S. Cl. ..... 202/241; 202/262; 202/248

[58] Field of Search ..... 202/227, 241, 262, 263, 202/248; 201/2; 196/122; 110/101 R; 214/18 R, 18 K, 18 PH

[56] References Cited

U.S. PATENT DOCUMENTS

| | | | |
|---|---|---|---|
| 323,323 | 7/1885 | Hack et al. | 202/262 |
| 3,436,316 | 4/1969 | Lorrek | 202/262 X |
| 3,709,794 | 1/1973 | Kiwzler et al. | 202/263 X |
| 3,766,018 | 10/1973 | Riechert | 202/263 X |
| 3,817,840 | 6/1974 | Stender | 202/262 X |
| 3,839,161 | 10/1974 | Pries | 202/227 X |
| 3,844,900 | 10/1974 | Schulte | 202/262 X |
| 3,913,470 | 10/1975 | Cullen | 202/263 X |
| 4,003,802 | 1/1977 | Pries | 202/241 |

*Primary Examiner*—Joseph Scovronek
*Assistant Examiner*—Michael S. Marcus
*Attorney, Agent, or Firm*—Karl F. Ross

[57] ABSTRACT

A main carriage is displaceable in a transport direction along rails next to the unloading side of a battery of coking chambers. A substantially smaller auxiliary frame is displaceable on the main frame in the same transport direction as the main frame and carries several operating units including a door-removing device, a doorframe cleaner and a guide for conducting coke pushed from the opposite side out of the chamber into a quenching wagon next to the battery. In addition a door cleaner may be provided on the main frame together with a chain conveyor or the like having one flight extending on the main frame in its transport direction next to the battery and another flight extending across the main frame perpendicular to the transport direction so as to empty into the quenching car. In operation the main frame is moved into an approach position of approximate confrontation of the operating units with a selected coking chamber and the auxiliary frame is then displaced exactly to position the devices sequentially in front of the door of the chamber for unloading a charge of cokefied coal.

8 Claims, 3 Drawing Figures

DISCHARGE APPARATUS FOR COKE-OVEN BATTERY

CROSS-REFERENCE TO RELATED APPLICATION

This application is related to our copending and commonly assigned patent applications Ser. Nos. 452,562, filed 19 Mar. 1974 and now abandoned, and 638,073 filed 5 Dec. 1975 as a continuation thereof.

FIELD OF THE INVENTION

The present invention relates to a coke oven. More particularly this invention concerns an unloading device for a coal-chemical-recovery coke oven.

BACKGROUND OF THE INVENTION

A coal-chemical-recovery coke oven as described on pages 7-66 of MECHANICAL ENGINEERS HANDBOOK (McGraw Hill:1958) is usually constituted as a battery formed of a horizontal row of vertically extending coking chambers. Each such chamber is normally around 40 feet long, 12 feet high and 15 inches wide, tapering approximately 3 inches from end to end. Each such chamber holds a charge of approximately 15 tons of coal. Flues between adjacent coking chambers are heated to approximately 2000° C. to carbonize the coal within the chamber or retort.

Once the coal within each charged chamber has been fully carbonized, doors are removed at both ends and the coke charge is pushed horizontally out of the oven by a ram of a pusher machine.

The coking chambers are usually filled through their tops, as described in our above-cited patent applications. The coke is usually pushed out into a quenching wagon and a hood or the like is fitted over the side of the arrangement in order to catch the air/gas/dust mixture that blows out of the coking chamber when it is open. Thus the filling wagon usually rides on rails above the coking battery, the pusher and door opener and other devices ride on tracks or rails next to the chambers, and the quenching wagon rides next to and below the battery so that the coke mass pushed out of the chambers will fall into it.

The various devices for removing the side doors of the coke battery, cleaning these doors and cleaning off the door frames, so that the doors can be fitted tightly back in place once the chamber is empty to prevent leakage during the next coking operation, usually ride on a frame alonside the coke battery. The individual devices are displaceable orthogonally on the frames relative to the longitudinal displacement direction, which is also the lengthwise direction of the coking battery. See German Auslegeschrift No. 1,225,142. The various devices are also pivotally on this frame.

The disadvantage of such an arrangement is that the considerable mass of this movable-frame assembly must be exactly displaced so as to align the various devices precisely with the individual coking chambers. Thus it is necessary to provide a very slowly operating and exactly controlled drive so that preparing each chamber for emptying and resealing it is a lengthy operation.

OBJECTS OF THE INVENTION

It is therefore an object of the present invention to provide an improved coking oven forming part of a coal-chemical-recovery system, in which the aforestated drawbacks are obviated.

Another object is the provision of a quick-operating discharge mechanism for such a system designed to decrease the cycling time of the coking-chamber battery.

SUMMARY OF THE INVENTION

According to a feature of our present invention, a main carriage is displaceable along a track in a predetermined transport direction along a battery of coke-oven chamber past the removable upright doors of the battery. Provided on this main carriage is an auxiliary carriage which is displaceable relative to the main carriage in the aforementioned transport direction. A door-opening unit and a doorframe cleaning unit as well as a guide unit for coke pushed out of the selected chamber are all mounted on the auxiliary carriage and are displaceable perpendicularly to the transport direction in order to align them with the chambers and allow the various operations to be carried out.

By virtue of the displaceability of the auxiliary carriage relative to the main carriage in the transport direction it is sufficient to bring the large and extremely bulky main carriage into an approach position of general alignment of the several operating units with the unloading doors of the battery of coking chambers. The lighter auxiliary carriage is then displaced along several of the doors, opening a door, cleaning the door frame, and allowing the coke charge in the chamber to be pushed out. The door and its frame are cleaned and the door can be replaced for recharging of the coking chamber.

According to another feature of this invention there is provided on the main frame a transport device for carrying away coke breeze, that is particles of coke that drop down into the discharge installation as the door is being opened and it and its frame are being cleaned. This transport device may comprise a chain conveyor having a first horizontally extending section lying on the side of the main frame adjacent the openable doors of the coke battery and another section extending at right angles to this first section and, therefore, orthogonally to the transport direction. The downstream end of this chain conveyor is above the path of a coke-receiving quenching wagon so that the coke breeze and other fines picked up by the conveyor can be dumped into that wagon.

With the system according to this invention it is therefore possible to move the very heavy and bulky main carriage into its approach position alongside the coke chamber to be opened without having to provide extremely precise positioning devices for this main carriage. Once it is in place the auxiliary carriage may be moved by lighter and simpler drives into the appropriate exact position next to the chamber to be opened. A system functioning in this manner is much less expensive and complex than the hitherto known types.

SPECIFIC DESCRIPTION

Figure 1:
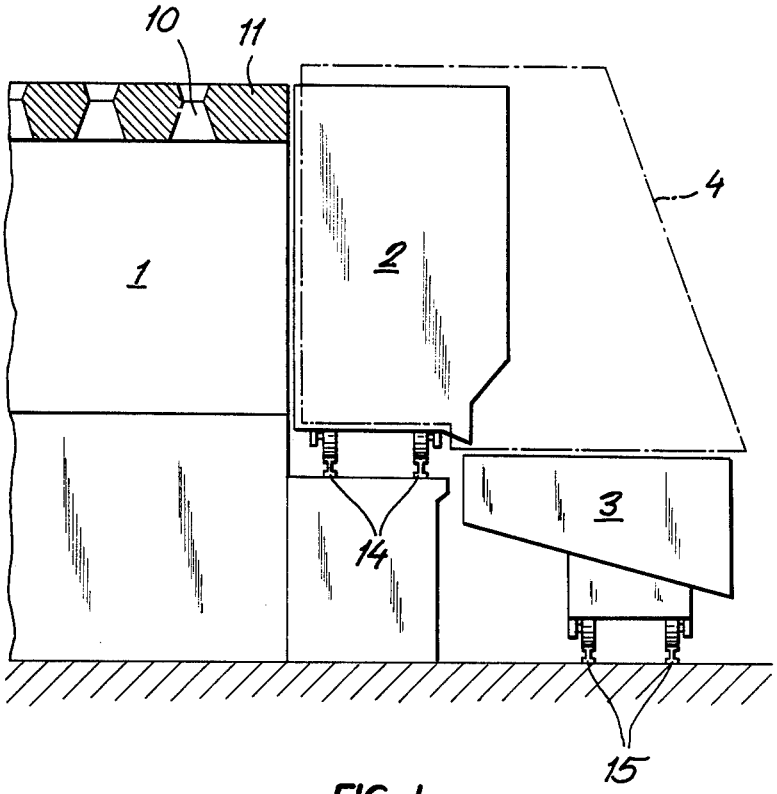
FIGS. 1, 2 and 3 are end, top and side views of a coking apparatus in accordance with the present invention.

As is shown in FIG. 1, a battery of coking chambers 1 as described in our above-cited copending patent applications open horizontally. Coal to be cokefied is fed in through holes 10 in the roof 11 of each chamber and doors 12 (see FIG. 2) are provided in the vertical oven walls 13. The end of each chamber 1 opposite that illustrated in FIG. 1 is provided with an ejector designed to push out a large block of coke formed in the chamber 1.

The unloading apparatus 2 rides next to the battery of chambers 1 on rails 14 defining a transport direction D. Riding on rails 15 parallel to the rails 14 but at a lower level is a quenching wagon 3. A hood as indicated at 4 may fit over the entire apparatus to prevent escape of the mixture of air, gas and dust during emptying of each of the chambers 1.

Figure 2:
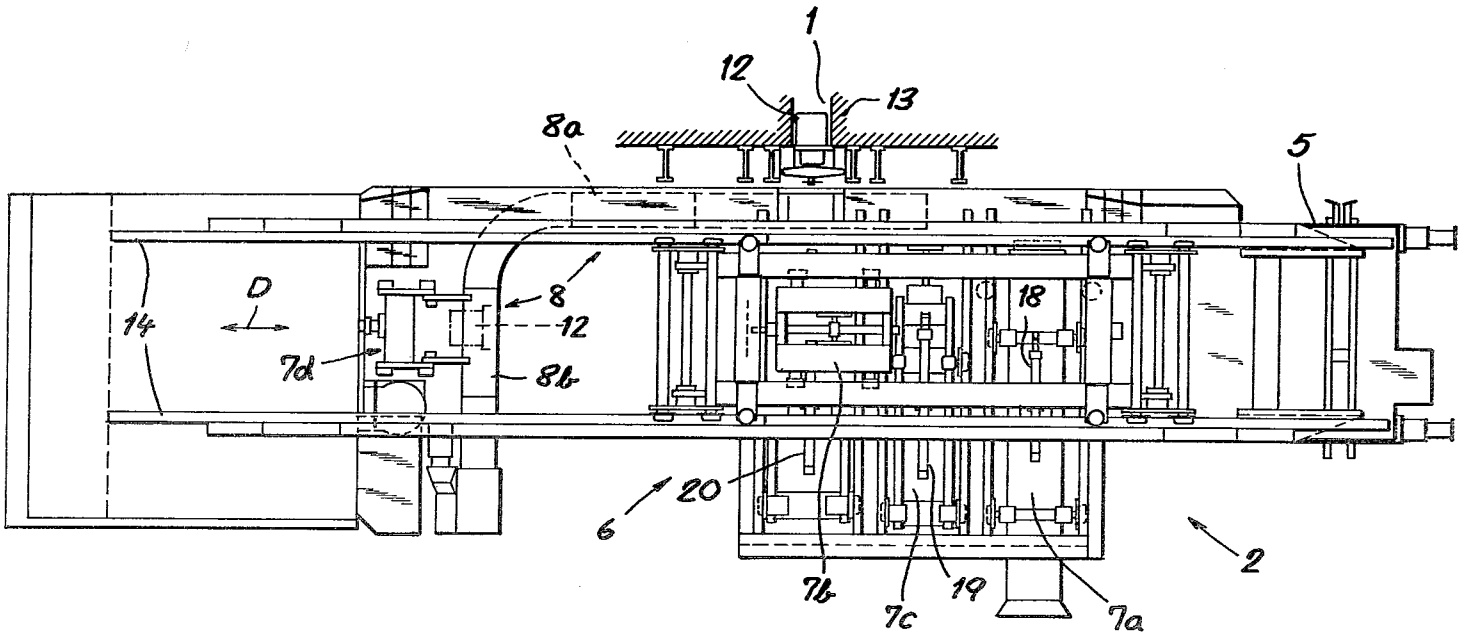
Figure 3:
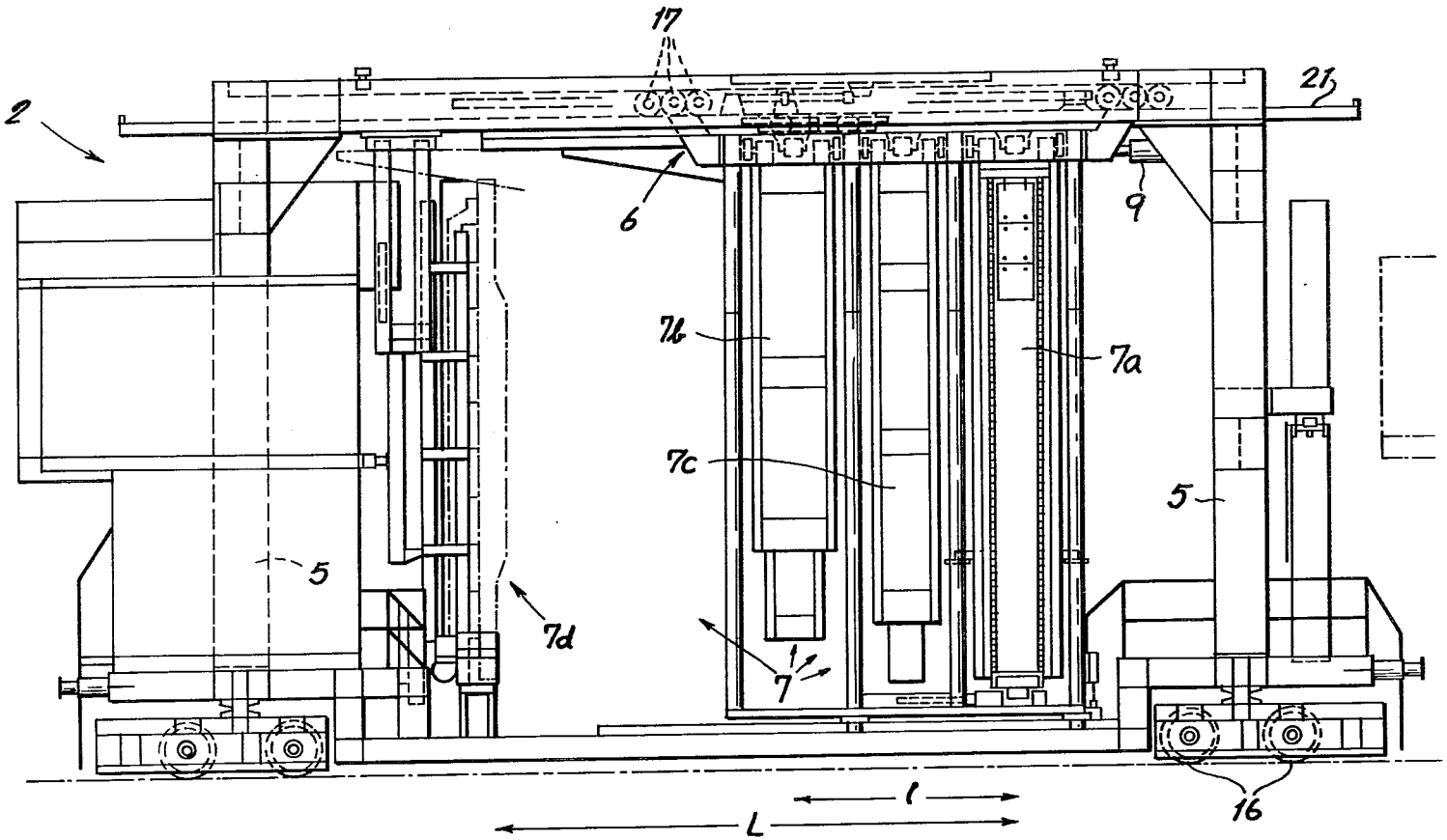

As shown in FIGS. 2 and 3, the unloading assembly 2 basically comprises a heavy-duty main frame supported by wheels 16 on the rails 14 and displeaceable in the direction D next to the chambers 1 which open orthogonally to this direction D. Suspended on rollers 17 from a secondary track 21 on carriage 5, above the primary track 14, is another carriage 6 that is displaceable on this carriage 5 in the transport direction D. A hydraulic ram indicated at 9 in FIG. 3 serves to displace this auxiliary carriage 6 on the main carriage 5.

The auxiliary carriage 6 carries various operating units 7 intervening in the unloading operation. These units include a large guide 7*a* acting as a chute for a coke charge that is pushed out of one of the chambers 1 so that it falls with minimum dust generation into the hopper wagon 3 which is then aligned with this chute on its track 15. There is also provided a door-opening unit 7*b* and a unit 7*c* for cleaning the door frame. A device 7*d* for cleaning the door itself is not carried on the auxiliary carriage 6 but is mounted directly on the carriage 5 at a location remote from the carriage 6. The units 7*a*, 7*b* and 7*c* are separately displaceable perpendicularly to the direction D by means of small cylinders indicated at 18, 19 and 20, respectively.

The auxiliary carriage 6 is limitedly displaceable on the main carriage 5 in the direction D through a distance L. The distance l between the center of the chute 7*a*, whose one side opens horizontally toward the oven wall 13 and whose other side opens downwardly toward the wagon 3, and the center of the door opener 7*b* is equal to at most L/2. Thus it is possible to move the main carriage 5 into its approach position and thereafter to align the various devices 7*a*–7*c* with the desired coking chamber without having to move the carriage 5 again. The auxiliary carriage 6 alone need be displaced to carry out all the operations necessary for emptying one chamber, and the positioning of the main carriage need not even be exact since the distance l of travel of the carriage 6 between alignment of the chute 7*a* at one end and alignment of the opener 7*b* at the other end may be smaller than L/2 by a margin sufficient to allow a rough prepositioning of operating units 7 by means of this larger carriage 5.

There is also provided on the main carriage an elbow-shaped chain-type conveyor 8 having a longitudinal stretch 8*a* extending parallel to the direction D on the side of the frame 5 immediately adjacent the openings for the chambers 1. A transverse stretch 8*b* extends perpendicularly to the direction D from the end of the stretch 8*a* and empties coke breeze, fines and the like that fall down on the stretch 8*a* into the hopper wagon 3. The stretch 8*a*, as seen in FIG. 2, lies between the path of carriage 6 (as defined by the secondary track 21) and an edge of carriage 5 proximal to the battery of coking chambers 1 whereby the coke breeze is initially carried off at right angles to the direction of removal of the coke charges by the unloading means 7.

In operation, carriage 5 is moved into the proper approach position in which the assembly 7 confronts one of the chambers 1. Unit 7*b* is then aligned by the drive 9 with the door 12 and this door 12 is lifted off. The door 12 is then pulled out of the way perpendicularly to the direction D and transported to the door-cleaning device 7*d* while unit 7*c* cleans the edge of the opening. Thereupon the chute 7*a* is aligned with the opening of the chamber 1 and the pusher device on the opposite side of the chamber 1 forces out the coke as a large block that crumbles and falls down and into the hopper 3. Afterward the doorframe cleaner 7*c* may again be employed. Meanwhile the door 12 has been cleaned by the device 7*d* and can be refitted into the cleaned-out opening in the end of the chamber 1.

We claim:

1. In a coke oven provided with a battery of coking chambers normally closed at one end by doors whose removal enables the ejection of a coke charge from each chamber, the combination therewith of:

a primary track extending past said battery in a predetermined transport direction;

a main carriage displaceable on said primary track in said transport direction;

a secondary track on said main carriage extending in said transport direction;

an auxiliary carriage limitedly displaceable on said secondary track in said transport direction relatively to said main carriage;

unloading means on said auxiliary carriage comprising a plurality of units disposed alongside one another for independent movement perpendicular to said transport direction toward and away from said battery for opening a selected chamber and enabling removal of the coke charge ejected therefrom, the range of displacement of said auxiliary carriage on said secondary track being sufficient to allow any one of said units to be operatively aligned with a selected chamber upon movement of said main carriage into an approach position close to the selected chamber;

positioning means for displacing said auxiliary carriage on said secondary track and said units on said auxiliary carriage; and generally elbow-shaped conveyor means on said main carriage for carrying off coke breeze dropping from the selected chamber upon the removal of its coke charge, said conveyor means including a longitudinal stretch extending in said transport direction between the path of displacement of said auxiliary carriage and an edge of said main carriage proximal to said battery whereby said coke breeze is removed from said coking chambers and initially carried off at right angles to the direction of removal of said coke charge by said unloading means.

2. The combination defined in claim 1 wherein said positioning means comprises a hydraulic drive on said main carriage for displacing said auxiliary carriage along said secondary track.

3. The combination defined in claim 1 wherein said units include a door-opening unit and a guiding unit for the ejected coke charge.

4. The combination defined in claim 3 wherein said units further include a doorframe-cleaning unit.

5. The combination defined in claim 1 wherein said secondary track is mounted at an elevated level on said main carriage, said auxiliary carriage being suspended from said secondary track.

6. The combination defined in claim 5 wherein said positioning means comprises a hydraulic ram on said main carriage linked with said auxiliary carriage below the level of said secondary track.

7. The combination defined in claim 1, further comprising an ancillary track extending generally parallel to said primary track for the guidance of a wagon, said transverse stretch terminating close to said ancillary track for discharging the removed coke breeze into said wagon.

8. The combination defined in claim 1 wherein said conveyor means is a chain conveyor further including a transverse stretch substantially perpendicular to said transport direction.

* * * * *